United States Patent [19]

Jansma et al.

[11] Patent Number: 4,856,540

[45] Date of Patent: Aug. 15, 1989

[54] CIGARETTE FILTER MODIFIER

[75] Inventors: Donald Jansma, Grand Rapids, Mich.; Howard W. Stemm, Lenexa, Kans.

[73] Assignee: Bissell Health Care Corporation, Grand Rapids, Mich.

[21] Appl. No.: 173,500

[22] Filed: Apr. 8, 1988

Related U.S. Application Data

[63] Continuation-in-part of Ser. No. 42,325, Apr. 24, 1987, abandoned.

[51] Int. Cl.[4] ..... A24D 3/04; A24F 13/08

[52] U.S. Cl. ..... 131/339; 131/189

[58] Field of Search ..... 131/188, 189, 201, 207, 131/225, 331, 339

[56] References Cited

U.S. PATENT DOCUMENTS

| | | | |
|---|---|---|---|
| 210,022 | 11/1878 | Goodwin | 131/189 |
| 1,556,236 | 10/1925 | Miller | 131/188 |
| 1,904,814 | 4/1933 | Anzelewitz | 131/188 |
| 2,231,298 | 2/1941 | Schlitz | 131/189 |
| 2,535,282 | 12/1950 | Goch | 131/188 |
| 3,144,023 | 8/1964 | Morceau | 131/189 |
| 3,502,087 | 3/1970 | Romano | 131/339 |

FOREIGN PATENT DOCUMENTS

| | | | |
|---|---|---|---|
| 539658 | 11/1931 | Fed. Rep. of Germany . | |
| 22025 | 5/1900 | Switzerland | 131/189 |
| 219611 | 7/0000 | United Kingdom | 131/189 |

*Primary Examiner*—V. Millin
*Assistant Examiner*—Robert W. Bahr
*Attorney, Agent, or Firm*—Price, Heneveld, Cooper, DeWitt & Litton

[57] ABSTRACT

The specification discloses a cigarette filter modifier and related method in which the pattern of tar and nicotine collection in a conventional cigarette filter is modified by the insertion into the filter of a hollow probe having apertures therein which communicate with the interior passageway of the probe, combined with a base shield radiating from and surrounding said probe so as to block the passage of smoke, thereby forcing cigarette smoke to travel through the apertures and interior passageway of said probe. The base shield is approximately the diameter of the cigarette, and its perimeter thereof defines the lateral extremes of the device so as to minimize its visibility.

24 Claims, 2 Drawing Sheets

CIGARETTE FILTER MODIFIER

CROSS REFERENCE TO RELATED APPLICATION

This is a continuation-in-part of U.S. patent application Ser. No. 07/042,325 filed Apr. 24, 1987 and entitled "CIGARETTE FILTER MODIFIER AND METHOD," which is expressly abandoned upon the filing of this application. Some of the claims of U.S. patent application Ser. No. 07/042,326 filed Apr. 24, 1987 and entitled "CIGARETTE HOLDER WITH FILTER MODIFIER, AND RELATED METHOD" are generic to this invention.

BACKGROUND OF THE INVENTION

The present invention relates to cigarette filtering devices. Many cigarettes are sold with an integral filter. Such filters typically comprise a short length of fibrous material located behind the tobacco portion of the cigarette. As the user draws on the cigarette, smoke passes through the fibrous material of the integral filter whereby tars and nicotine are at least partially filtered out of the smoke.

There are cigarette holders on the market which further filter tars and nicotine from the smoke leaving a cigarette, even a cigarette which already includes an integral filter. One such holder defines a tortuous path through which the smoke must travel before it reaches the smoker's mouth. It removes as much as 30% of the tars and nicotine which manage to escape the integral cigarette filter and which would otherwise reach the smoker's mouth. Another holder utilizes a moistened cellulose acetate material to filter the smoke.

One problem with such filtering cigarette holders is that they are very noticeable when used. Also, they alter the draw characteristics of the cigarette. As a result, only a small percentage of smokers use such devices, even though they would benefit from such use in terms of reduced tar and nicotine intake.

SUMMARY OF THE INVENTION

The device of the present invention is a cigarette filter modifier, rather than a cigarette holder or secondary filter, comprising essentially an annular disk defining a base shield and a probe extending forwardly from the base shield for insertion into the integral filter of a cigarette. The disk is of an outside diameter which approximates the diameter of a cigarette filter, and the perimeter of the disk defines the lateral extremities of the device. The disk is thin relative to the length of a cigarette so as to be relatively unnoticeable and readily locatable entirely within the smoker's mouth in use. the probe includes an aperture opening to the interior thereof. An interior passageway communicates with the probe aperture and extends therefrom through the probe and through the base shield. The base shield blocks the passage of smoke through the end of the integral filter and forces smoke to travel instead through the aforesaid probe aperture and interior passageway when the smoker draws on the cigarette.

Use of this device removes up to about 60% or more of the tars and nicotine which would otherwise pass through a conventional integral cigarette filter and go directly to the smoker's mouth, throat and lungs. It also draws naturally and is unnoticeable in use. It cannot even be seen when the cigarette is in the smoker's mouth. These and other features, objects and advantages of the invention will be more fully understood and appreciated by reference to the written specification and appended drawings.

DESCRIPTION OF THE PREFERRED EMBODIMENT

Figure 1:
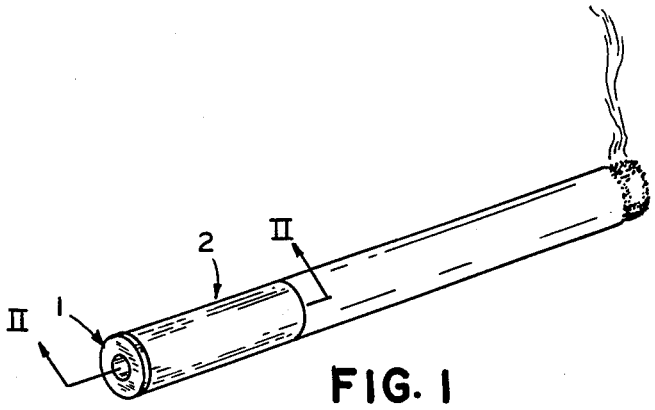
FIG. 1 is a perspective view of the filter modifying device of the present invention inserted in the end of a cigarette.
Figure 2:
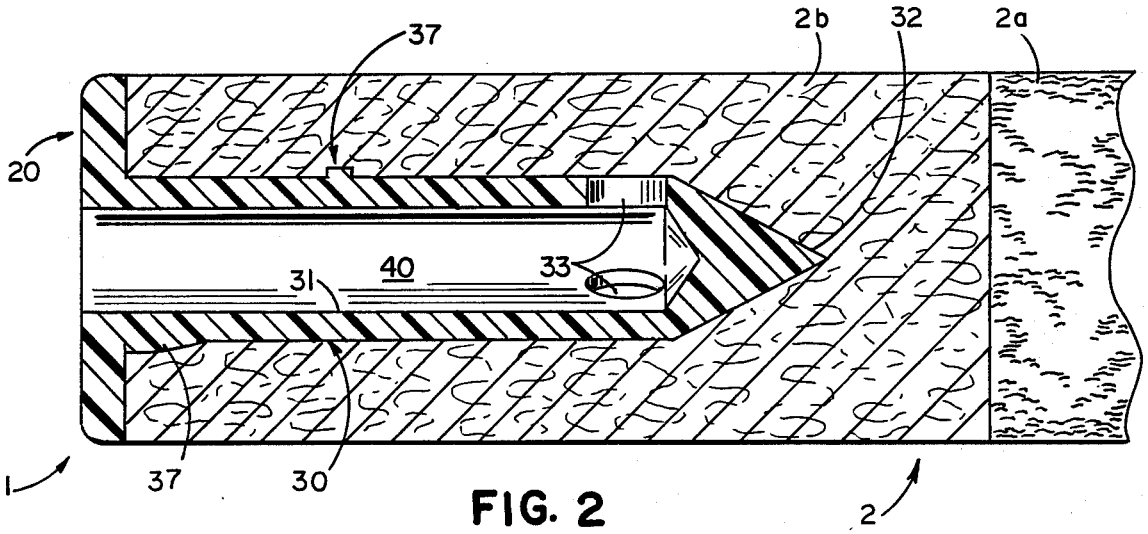
FIG. 2 is a cross-sectional view taken generally along plane II—II of FIG. 1.
Figure 3:
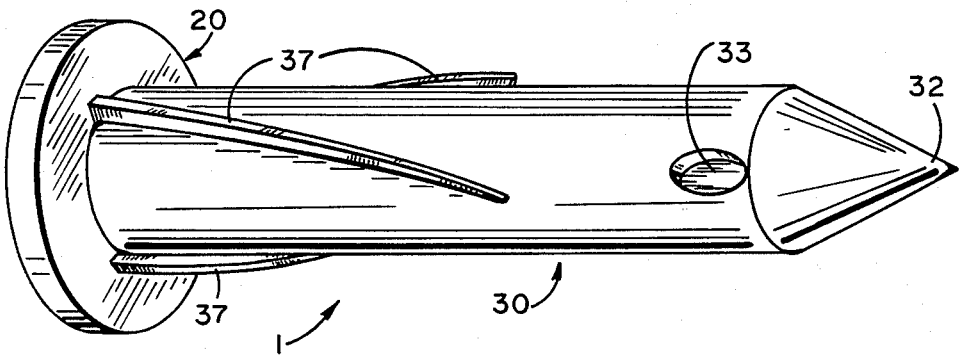
FIG. 3 is a perspective view of the filter modifying device of the present invention.

In the preferred embodiment, filter modifier 1 comprises an annular disk-shaped base shield 20 which includes a probe 30 extending forwardly therefrom for insertion into an integral filter **2*b* of a cigarette 2 (FIGS. 1, 2 and 3). Holding means 37 help hold device 1 in position within filter 2*b* when the user draws on cigarette 2. Probe 30 includes three apertures 33 communicating with the interior thereof and an interior passageway 40 extending from probe apertures 33 rearwardly to and through base shield 20. Base shield 20 itself substantially blocks the passage of smoke, whereby the substantial majority of the smoke must travel through apertures 33 and passageway 40 to reach the user's mouth. This alters the flow characteristics of integral filter 2*b*** and facilitates the surprisingly improved filtering results discussed above in the Summary of the Invention.

Filter modifier 1 is preferably integrally molded of a sturdy plastic material. Base shield 20 comprises an annular disk integral with and radiating outwardly from the base of probe 30. Base shield 20 is approximately the diameter of a cigarette. The term "approximately" as used in reference to this is intended to include variations which may be slightly larger or slightly smaller. No more than about 15% of the area of the end of filter **2*b* should be uncovered by base shield 20. At that percent, approximately 50% of the tar and nicotine which would otherwise pass through filter 2*b* is removed. When the end of filter 2*b* is 100% covered, incremental tar and nicotine removal is about 80%. One might wish to offer two different sized base shields, one for normal diameter cigarettes and one for the so-called "slim" cigarettes. base shield 20 is solid so as to substantially block the passage of smoke from the cigarette to the user's mouth, except through passageway 40**.

Base shield 20 is also relatively thin, relative to the length of a cigarette. This low profile makes it almost unnoticeable in use. It also makes it possible to smoke the cigarette just as one normally would. Shield 20 fits easily entirely inside the user's mouth during smoking. Base shield 20 defines the end of the device, there being no other rearward projections detracting from its unobtrusiveness.

Probe 30 which extends forwardly from base shield 20 comprises a generally cylindrical sidewall 31 which terminates at a cone-shaped tip 32 at the end thereof. There are three probe apertures 33 spaced equidistant around the circumference of probe sidewall 31. This arrangement is preferable in that is provides sufficient openings to facilitate an easy draw on the cigarette, and yet results in each aperture 33 being located opposite a solid portion of sidewall 31. It is also important in the narrower aspects of the present invention that each aperture 33 open laterally outwardly with respect to the length of sidewall 31 in order that smoke entering each aperture 33 has to make a sharp turn in order to be drawn into the interior passageway 40 of filter modifier 1. In this way, tar and nicotine particles which are drawn laterally into the interior of passageway 40 tend to be accelerated towards the opposite solid wall portion of sidewall 31 where they tend to stick and collect on the interior thereof rather than be carried into the user's mouth and lungs. In contrast, if aperture 33 opened forwardly towards the point 32 of probe 30, smoke and air would tend to be drawn into passageway 40 in a longitudinal line and would have less tendency to be thrown against sidewall 31 of probe 30. Similarly, if two apertures 33 were located directly opposite one another, there would be a tendency for the smoke and air flow from each to mix and travel down the center of passageway 40, rather than be accelerated against an opposite solid wall portion of sidewall 31. Hence, making apertures 33 laterally opening and orienting apertures 33 such that each is located opposite a solid portion of sidewall 31 are most preferable embodiments of the invention.

Further, it is preferable that apertures 33 be located towards the front end 32 of probe 30. This allows for more tar and nicotine buildup on the inside of probe sidewall 31 before filter modifier 1 has to be thrown away. While the overall operation of modifier 1 in removing contaminants is slightly better when apertures 33 are located closer to base shield 20, it is preferred to locate apertures 33 forwardly to render modifier 1 more reuseable and minimize the possibility of tars oozing out of the end of passageway 40 into the user's mouth. However, apertures 33 should preferably not open into cone area 32 as this would make them longitudinally opening rather than laterally opening, allowing them to draw smoke in without forcing it to turn.

Apertures 33 should be sufficiently large as to facilitate a relatively easy draw on the cigarette. However, each aperture should be no more than about 0.1 inches in length along the longitudinal axis of probe 30, and more preferably should be no more than about 0.075 inches in length. If apertures 33 are too long along the length of probe 30, it becomes too easy for smoke to pass generally longitudinally through the apertures rather than being forced to make a sharp turn entering each aperture and make another sharp turn to travel down the length of passageway 40. Further, the overall cross-sectional area of apertures 33 should be no more than about 0.0135 square inches and preferably no more than about 0.0080 square inches. Most preferably, this area is divided between three separate apertures 33, rather than being concentrated in one aperture.

The cross-sectional area of passageway 40 also must be sufficiently great to allow for easy draw. However, it should be no more than about 0.008 square inches and preferably no more than about 0.006 square inches, most preferably about 0.004 square inches. If the cross-sectional area becomes too great, there is less tendency for contaminate particles to be forced against a passage sidewall and be removed by adherence thereto. Experimental data reveals that at a passageway cross-sectional area of about 0.008 square inches, device 1 removes approximately half the contaminates that are removed when the cross-sectional area of passageway 40 is 0.004 square inches.

Probe passageway 40 which extends from apertures 33 rearwardly to and through base shield 20. Passageway 40 tapers inwardly slightly as one proceeds forwardly along the length of probe 30, facilitating molding. Similarly, all of the wall sections of device and probe 30 taper outwardly slightly towards base wall 20 to facilitate ease of molding. The taper need only be slight and is not noticeable in the drawings.

Probe 30 includes a spiral thread 37 projecting from its exterior surface (FIGS. 2 and 3). Spiral thread 37 serves as a holding means when device 1 is pushed into position to help hold filter modifier 1 in place in cigarette 2 in use. This helps prevent a smoker from sucking device 1 into his or her mouth when smoking the cigarette.

The length of probe 30 is such that is will extend into integral filter **2*b*, whether a regular diameter cigarette is used or a so-called slim cigarette is used, but not so long as to project completely through integral filter 2*b* when a slim cigarette is used. The length of probe 30 is preferably about three-quarters of the length of a typical cigarette filter, thereby locating the apertures 33 at a point about two-thirds down the length of filter 2*b* towards the cigarette tobacco portion 2a of the cigarette. This allows a portion of the existing filter 2*b* to filter some of the smoke before it enters filter modifier 1. Yet, it leaves a substantial length of interior passageway 40 to collect tar and nicotine along the interior sides of probe sidewall 31**.

In a best mode, probe 30 is about 0.6 to 0.7 inches long. Apertures 33 are located to start at about 0.4 inches up the length of probe 30 from base shield 20. They are about 0.03 to 0.04 inches wide and about 0.07 to 0.08 inches long. The diameter of passageway 40 is about 0.071 inches, for a cross-section of about 0.004 square inches. Shield 20 is about 0.28 inches in diameter for so-called "slim" cigarettes and about 0.32 inches in diameter for regular diameter cigarettes. At 0.32 inches, 100% of the area of the end of filter **2*b*** is covered. This is the most preferred embodiment of the best mode.

Figure 4:
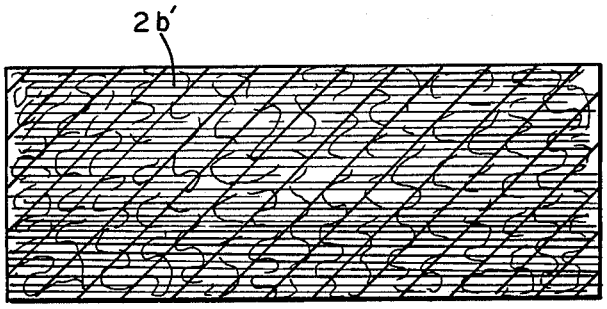
FIG. 4 (PRIOR ART)
FIG. 4 is a longitudinal cross-sectional view of a conventional integral cigarette filter darkened to illustrate the pattern of tar and nicotine collection in the filter.
Figure 5:
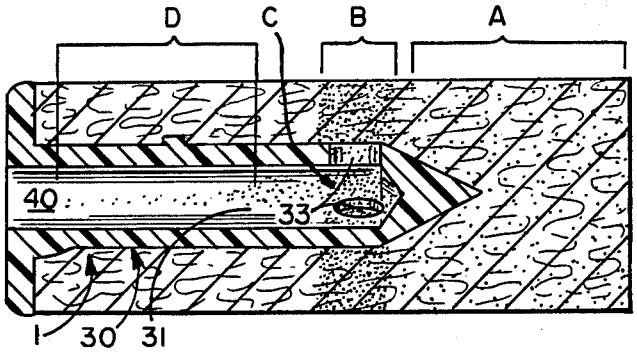
FIG. 5 is a longitudinal cross-sectional view of a conventional cigarette filter after having been used in conjunction with the device of the present invention, darkened so as to illustrate the tar and nicotine collection pattern of the filter.

FIGS. 4 and 5 compare the tar and nicotine collection pattern for two conventional integral cigarette filters **2*b*' and 2*b* respectively. Filter 2*b*' of FIG. 4 shows the uniform tar and nicotine collection pattern obtained when one does not use filter modifier 1 of the present invention. On the other hand, filter 2*b* shown in FIG. 5 illustrates the significantly altered tar and nicotine collection pattern when filter modifier 1 of the present invention is inserted into a conventional integral cigarette filter. In the end of the filter in front of a probe apertures 33 (area A), a fairly uniform tar and nicotine collection pattern develops comparable to, but perhaps somewhat heavier than, that seen in filter 2*b*'. However at the location of apertures 33** (area B), a very heavy concentration of tar and nicotine begins to appear.

Within the interior passage 40 of filter modifier 1, one sees a heavy buildup of tar and nicotine in the area C of the inside of probe sidewall 31 which is opposite one of the aperture openings 33 (not shown). The deposit of tars and nicotines continues down the length of the interior of probe 30 (area D). As a result of this altered tar and nicotine deposit pattern in the filter 2b, and as a result of tar and nicotine deposit on the inside wall of probe 30, up to 60% or more tar and nicotine is removed than would be the case with filter 2b' used without filter modifier 1 of the present invention.

The reasons for the surprising improvement in filter performance when the present invention is used are no known for certain. However, it is believed that by embedding apertured probe 30 within fibrous filter 2b, smoke passing through filter 2b is forced to turn inwardly toward probe 30 as pass laterally through fibrous filaments which are oriented longitudinally of filter 2b. This is believed to result in enhanced collection of tars and nicotines on the fibers.

Further, it is believed that by forcing the smoke to concentrate in order to enter the relatively small apertures 33 (compared to the overall cross-sectional diameter of filter 2b), tars and nicotine are forced to "bunch up." Because they are sticky materials, they tend to agglomerate into larger tar and nicotine particles which are more easily filtered by the fibrous filter material in the vicinity of apertures 33.

In this regard, it is important that apertures 33 have a relatively small cross-sectional area as compared with the overall cross-sectional area of filter 2b. This result follows by placing the apertures in probe 30, since the apertures have to be relatively small in order to be located in probe 30. By using three apertures instead of one, each of the apertures can be a little smaller to enhance tar and nicotine collection at each, while leaving the combined cross-sectional area of all three apertures sufficiently large that the draw of the cigarette is not substantially restricted by the use of device 1. It is known that the aperture dimensions given above operate very well to enhance filtration without detracting from the draw of the cigarette. Those skilled in the art will find it easy to experiment with aperture size variations if desired.

In addition to the foregoing, the relatively small cross-sectional area of the apertures 33 as compared to the overall flow area of filter 2b causes air and smoke to accelerate as it enters the vicinity of apertures 33. This acceleration may also have an impact on the enhanced filtration achieved by device 1 in that the inertia of tar and nicotine components may cause them to be "left behind" to be trapped by the fibrous filter material.

Once the tar and nicotine particles are accelerated into the interior of probe 30, they tend first to be accelerated against the opposite interior sidewall portion where they tend to stick to the sidewall 31 of passageway 40. They then continue to collect on the remainder of interior sidewall 31 as one proceeds towards base shield 20. This collection of tar and nicotine particles on the interior sidewall 31 of probe 30 is believed to be a contributing factor in reducing the tar and nicotine content that eventually reaches the user's mouth.

Another surprising result of use of the present invention is that carbon monoxide levels reaching the user are reduced. Up to 50% of the carbon monoxide which would otherwise reach the user is removed if the end of filter 2b is 100% sealed by base shield 20. Fifteen to 20% of the carbon monoxide is removed if base shield 20 covers only 85 to 90% of the end of filter 2b. The reasons for this surprising reduction in carbon monoxide passage have not yet been explained.

All of the foregoing possible explanations are somewhat theoretical. What is known for certain is that device 1 in accordance with the present invention substantially enhances the filtration characteristics of conventional fibrous filters, removing as much as 60% or more of tars and nicotine which would otherwise pass through such filters.

Figure 6:
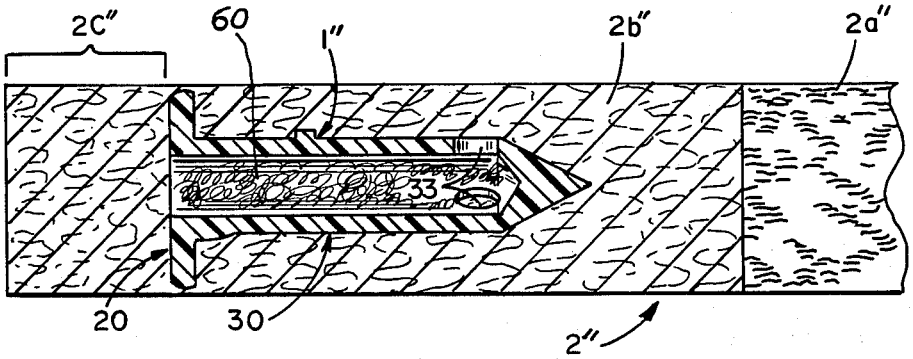
FIG. 6 is a longitudinal cross-sectional view of an alternative embodiment of the invention in which the filter modifier is embedded within an otherwise conventional cigarette filter.

FIG. 6 discloses an alternative embodiment of the present invention in which the filter portion 2b'' of a conventional cigarette 2'' has been permanently modified by embedding a filter modifying device 1'' in accordance with the present invention therein. Filter modifier 1'' is very similar to device 1 except that the holding thread 37 has been eliminated from the exterior surface of probe 30. By permanently modifying a filter portion 2b'' in this manner, the smoker never even sees filter modifier 1''. Preferably, there is fibrous filter material on both sides of base shield 20, e.g., filter portion 2c''.

In either embodiment, the operation of filter modifier 1 or 1'' is the same. The passage of smoke directly through the length of filter 2b or 2b'' is substantially prevented by base shield 20. Instead, smoke has to pass through aperture 33, down the length of interior passageway 40 and then into the user's mouth. In the case of the alternative embodiment disclosed in FIG. 6, the smoke also passes through a short rear filter portion 2c'' located behind base shield 20 before it reaches the smoker's mouth.

In either embodiment, modifier 1 or 1'' is either totally hidden from view or is substantially hidden from view. It is barely noticeable to others, if at all, when being used by a smoker in the first embodiment. It is not visible at all, even in the first embodiment, when the cigarette is in the user's mouth.

In yet another embodiment of the present invention, the interior passageway 40 of probe 30 is itself filled with a secondary filtering medium. This secondary medium could be a fibrous material such as the cellulose acetate fibers used in typical cigarette filters. It could be water impregnated cellulose acetate fibers or fibrous material. It could involve the modification of passageway 40 to make it more tortuous. The term "secondary filtering medium" is used herein in relationship to placing same within interior passageway 40 is intended to include any of the foregoing or other similar variations.

Of course, it is understood that the above is a preferred embodiment of the invention and that various changes and alterations can be made without departing from the spirit and broader aspects thereof. For example, it is understood that in the broader aspects of the invention, the device of the invention could be used in conjunction with a cigarette having no integral filter, and thus serve as a filtering device per se. Such use is contemplated in the broadest aspects of the invention, but is not the preferred use contemplated.

The embodiments of the invention in which an exclusive property or privilege is claimed are defined as follows:

1. A cigarette filter modifier for insertion into a filter of a cigarette, the filter including an end area and a peripheral surface, said modifier comprising:

an annular, thin disk defining a base shield, said base shield being relatively thin with respect to a filter of a cigarette and wherein the disk is dimensioned to overlie only an end area of the filter and not the peripheral surface of the filter whereby the modifier is relatively unnoticeable and can be readily located entirely within a smoker's mouth in use;

an elongated probe projecting from said base shield;

holding means on said probe for assisting in holding said modifier within the cigarette filter when inserted therein;

a plurality of probe apertures in said probe communicating with the interior thereof;

an interior passage in flow communication with said probe apertures and extending through the interior of said probe at least from said probe apertures to and through said base shield;

said base shield being approximately as large in diameter as the diameter of the cigarette filter whereby passage of smoke is blocked by said shield and smoke is forced through said probe apertures and through said interior passage when a cigarette containing said probe is drawn upon; the perimeter of said base shield defining the lateral extremities of said modifier whereby said modifier is substantially unnoticeable when placed in the end of a cigarette and wherein said probe apertures open generally laterally with respect to the longitudinal axis of said probe whereby smoke being drawn from a cigarette into said probe apertures is forced to turn sharply with respect to the longitudinal axis of flow of smoke through the filter in order to enter said apertures and is forced to turn another sharp turn in order to pass down the length of said interior passage of said probe, each of said apertures having a length less than 0.1 inch along the longitudinal axis of said probe, the overall combined area of said apertures being less than about 0.0135 square inches and the interior passage of said probe having a cross section no greater than about 0.008 square inches.

2. The device of claim 1 wherein said probe comprises a longitudinally extending, generally cylindrical sidewall, there being three said probe apertures spaced around the circumference of said probe sidewall.

3. The device of claim 1 in which said probe aperture is located opposite a solid wall portion of said probe whereby tar and nicotine particles being drawn into said aperture tend to be forced against said solid wall and stick thereto.

4. The device of claim 3 wherein said probe comprises a longitudinally extending, generally cylindrical sidewall, there being three said probe apertures of approximately equal area spaced around the circumference of said probe sidewall.

5. The device of claim 4 in which the length of each said aperture is less than about 0.075 inches along the length of said probe; said overall aperture area is less than about 0.0080 square inches; and the overall cross-sectional area of said probe passageway is less than about 0.006 square inches.

6. The device of claim 5 in which said apertures are located adjacent the front of said probe.

7. The device of claim 3 in which said base shield is sufficiently large that it will cover at least about 85% of the end area of a cigarette filter.

8. The device of claim 1 in which said interior passage of said probe includes a secondary filtering medium therein.

9. A filter cigarette including a tobacco portion, a conventional fiber filter portion having an end area and an outer periphery and a modifier, said modifier comprising:

an annular, thin disk defining a base shield, said base shield being relatively thin with respect to the length of the fiber filter portion whereby it is relatively unnoticeable and can be readily located entirely within a smoker's mouth in use;

an elongated probe projecting from said base shield into said fiber filter portion;

at least one aperture in said probe communicating with the interior thereof and located within said fiber filter portion;

an interior passage in flow communication with said probe aperture and extending through the interior of said probe at least from said probe aperture to and through said base shield, said probe aperture opening generally laterally with respect to the longitudinal axis of said probe whereby smoke being drawn from the cigarette into said probe aperture is forced to turn sharply with respect to the longitudinal axis of flow of smoke through the cigarette filter portion in order to enter said aperture and is forced to turn another sharp turn in order to pass down the length of said interior passage of said probe;

said base shield being approximately as large in diameter as the diameter of said fiber filter portion and overlying only said end area of said filter portion whereby passage of smoke is blocked by said shield and is forced through said probe aperture and through said interior passage when said cigarette is drawn upon; the perimeter of said base shield defining the lateral extremities of said device whereby said device is substantially unnoticeable when placed in the end of a cigarette.

10. A filter cigarette of claim 9 further including holding means on said probe to assist in holding said device within a cigarette filter when it is inserted therein.

11. The filter cigarette of claim 9 wherein said probe comprises a longitudinally extending, generally cylindrical sidewall, there being three said probe apertures spaced around the circumference of said probe sidewall.

12. The filter cigarette of claim 9 in which said probe aperture is located opposite a solid wall portion of said probe whereby tar and nicotine particles being drawn into said aperture tend to be forced against said solid wall and stick thereto.

13. The filter cigarette of claim 12 wherein said probe comprises a longitudinally extending, generally cylindrical sidewall, there being three said probe apertures of approximately equal area spaced around the circumference of said probe sidewall, each said aperture being sufficiently large to facilitate draw but less than 0.1 inch in length along the longitudinal axis of said probe and the overall combined area of said apertures being less than about 0.0135 square inches;

said interior passage of said probe being sufficiently large in cross-section to facilitate draw but being no greater than about 0.008 square inches.

14. The filter cigarette of claim 13 in which the length of each said aperture is less than about 0.075 inches along the length of said probe; said overall aperture area is less than about 0.0080 square inches; and the overall cross-sectional area of said probe passageway is less than about 0.006 square inches.

15. The filter cigarette of claim 14 in which said aperture are located adjacent the front of said probe.

16. The filter cigarette of claim 12 in which said base shield is sufficiently large that it will cover at least about 85% of the end area of the cigarette filter.

17. The filter cigarette of claim 9 in which said interior passage of said probe includes a secondary filtering medium therein.

18. The filter cigarette of claim 9 in which said modifier is embedded within said fiber filter as an integral part thereof, said fibrous filter including a cover and fibrous material, said cover covering said modifier as well as said fibrous material.

19. The filter cigarette of claim 18 in which said fibrous filter material is located on both sides of said base shield.

20. The filter cigarette of claim 19 in which said probe aperture opens generally laterally with respect to the longitudinal axis of said probe whereby smoke being drawn from a cigarette into said probe aperture is forced to turn sharply with respect to the longitudinal axis of flow of smoke through a cigarette filter in order to enter said aperture, and is forced to turn another sharp turn in order to pass down the length of said interior passage of said probe.

21. The filter cigarette of claim 20 in which said probe aperture is located opposite a solid wall portion of said probe whereby tar and nicotine particles being drawn into said aperture tend to be forced against said solid wall and stick thereto.

22. The filter cigarette of claim 21 wherein said probe comprises a longitudinally extending, generally cylindrical sidewall, there being three said probe apertures of approximately equal area spaced around the circumference of said probe sidewall, each said aperture being sufficiently large to facilitate draw but less than 0.1 inch in length along the longitudinal axis of said probe and the overall combined area of said apertures being less than about 0.0135 square inches;

said interior passage of said probe being sufficiently large in cross-section to facilitate draw but being no greater than about 0.008 square inches.

23. The filter cigarette of claim 22 in which the length of each said aperture is less than about 0.075 inches along the length of said probe; said overall aperture area is less than about 0.0080 square inches; and the overall cross-sectional area of said probe passageway is less than about 0.006 square inches.

24. The filter device of claim 18 in which said interior passage of said probe includes a secondary filtering medium therein.

* * * * *

UNITED STATES PATENT AND TRADEMARK OFFICE

CERTIFICATE OF CORRECTION

PATENT NO. : 4,856,540

DATED : August 15, 1989

INVENTOR(S) : Donald Jansma and Howard W. Stemm

It is certified that error appears in the above-identified patent and that said Letters Patent is hereby corrected as shown below:

Column 4, Line 53:

"of" should be --and--

Column 4, Line 63:

After "of" delete --a--

Column 5, Line 13:

"no" should be --not--

Column 5, Line 17:

"as" should be --and--

Column 8, Claim 15, Lines 67 and 68:

"aperture" should be --apertures--

Signed and Sealed this

Fourteenth Day of May, 1991

*Attest:*

*Attesting Officer*

HARRY F. MANBECK, JR.

*Commissioner of Patents and Trademarks*